United States Patent [19]

Nicolson

[11] Patent Number: 4,970,516

[45] Date of Patent: Nov. 13, 1990

[54] SEAGOING VESSELS

[76] Inventor: Ian M. Nicolson, Linnfield Cove, Helensburgh, Dunbartonshire, Great Britain, G84 ONS

[21] Appl. No.: 389,525

[22] Filed: Aug. 4, 1989

Related U.S. Application Data

[60] Continuation of Ser. No. 867,898, May 20, 1986, abandoned, which is a division of Ser. No. 713,260, Mar. 19, 1985, abandoned.

[30] Foreign Application Priority Data

Mar. 22, 1984 [GB] United Kingdom ..... 8407446

[51] Int. Cl.[5] ..... H04K 3/00; G01S 7/38

[52] U.S. Cl. ..... 342/13; 342/9; 342/5; 342/14; 244/190; 89/1.11

[58] Field of Search ..... 242/5, 8, 9, 10, 13, 242/14, 15; 89/1.11; 244/190

[56] References Cited

U.S. PATENT DOCUMENTS

| | | | |
|---|---|---|---|
| 3,891,985 | 6/1975 | Oigarden | 342/60 X |
| 3,900,198 | 8/1975 | Conner | 244/79 X |
| 3,943,357 | 3/1976 | Culver | 244/77 R X |
| 4,069,726 | 1/1978 | Maury | 102/90 |
| 4,178,596 | 12/1979 | Rowlett | 343/705 |
| 4,215,630 | 8/1980 | Hagelberg et al. | 102/10 |
| 4,241,426 | 12/1980 | Wells Sr. | 367/1 |
| 4,354,419 | 10/1982 | Patterson | 244/3.1 X |
| 4,505,441 | 3/1985 | Kirsch et al. | 244/3.15 |
| 4,505,442 | 3/1985 | Kirsch et al. | 244/3.15 |
| 4,546,983 | 10/1985 | Rosa | 273/348.1 |
| 4,659,089 | 4/1987 | Rosa | 342/9 X |
| 4,695,841 | 9/1987 | Billard | 342/8 |
| 4,720,058 | 1/1988 | Jaeger | 89/1.11 X |
| 4,738,411 | 4/1988 | Ahlström et al. | 89/1.11 X |
| 4,768,417 | 9/1988 | Wright | 89/1.11 |

*Primary Examiner*—Thomas H. Tarcza
*Assistant Examiner*—John B. Sotomayor
*Attorney, Agent, or Firm*—Bell, Seltzer, Park & Gibson

[57] ABSTRACT

A sacrificial seagoing vessel comprises an automatic navigation system which is operable remotely to maintain the sacrificial vessel in a predetermined orientation and position with respect to a predetermined conventional vessel which is to be safeguarded from enemy projectiles, the sacrificial vessel being attractive to projectiles. The attraction may be provided by enhanced radar signature or by emission of signals at a substantially greater level occurring from a conventional seagoing vessel.

6 Claims, 2 Drawing Sheets

NOTE L
IF 'BLIP' MOVES INTO THIS ARC 'S-S' TURNS TO PORT

NOTE M
IF 'BLIP' MOVES INTO THIS ARC 'S-S' TURNS TO STBD

NOTE N
IF 'BLIP' MOVES AFT OF THIS LINE 'S-S' SLOWS AND EVENTUALLY STOPS

NOTE P
IF 'BLIP' MOVES INTO THIS LINE 'S-S' SPEEDS UP TILL 'BLIP' DROPS BACK TO BEHIND LINE

NOTE Q
AS LONG AS 'BLIP' STAYS IN SHADED AREA 'S-S' MAINTAINS COURSE AND SPEED UNCHANGED

NOTE L
IF 'BLIP' MOVES INTO THIS ARC 'S–S' TURNS TO PORT

NOTE M
IF 'BLIP' MOVES INTO THIS ARC 'S–S' TURNS TO STBD

NOTE N
IF 'BLIP' MOVES AFT OF THIS LINE 'S–S' SLOWS AND EVENTUALLY STOPS

NOTE P
IF 'BLIP' MOVES INTO THIS LINE 'S–S' SPEEDS UP TILL 'BLIP' DROPS BACK TO BEHIND LINE

NOTE Q
AS LONG AS 'BLIP' STAYS IN SHADED AREA 'S–S' MAINTAINS COURSE AND SPEED UNCHANGED

SEAGOING VESSELS

CROSS-REFERENCE TO RELATED APPLICATIONS

This application is a continuation of copending application Ser. No. 867,898 filed May 20, 1986, which in turn is a division of application Ser. No. 713,260 filed Mar. 19, 1985, both now abandoned.

FIELD AND BACKGROUND OF THE INVENTION

This invention relates to seagoing vessels.

Under hostile conditions conventional seagoing vessels are vulnerable to enemy attack by projectiles travelling on the sea, under the sea and in the air arising from enemy location of such vessels by visual means, radar, sonar or infrared detectors. However under maritime conditions where distances between opposing forces are usually relatively large, it is relatively difficult for an enemy to pinpoint any one particular vessel forming part of a cluster of vessels. Furthermore enemy projectiles are nowadays frequently of the heat-seeking type. Consequently, heat-seeking projectiles cannot be selectively directed to impinge upon and harm any one particular vessel, since heat seeking projectiles locate the strongest heat source as a target while in transit.

It is an object of the present invention to provide a new and improved form of defense for seagoing vessels.

SUMMARY OF THE INVENTION

According to the present invention there is provided a method of protecting a seagoing vessel that generates signals which are attractive to hostile projectiles and which enable hostile projectiles to locate and harm the seagoing vessel, which method comprises the following steps. First, a sacrificial decoy vessel is provided having propulsion means and directional steering means. The seagoing vessel is directed along a path of travel and the propulsion means and directional steering means of the decoy vessel are remotely controlled as the seagoing vessel moves along its path of travel so as to maintain the decoy vessel within a predetermined distance of the seagoing vessel. The sacrificial decoy vessel generates signals which are attractive to hostile projectiles and which are substantially greater in magnitude than the projectiles protractive signals generated by the seagoing vessel such that the sacrificial seagoing vessel constitutes a preferred target over the seagoing vessel to hostile projectiles intended for the seagoing vessel.

Signals which hostile projectiles may use to locate and harm seagoing vessels include heat emission signals, radio wave emission signals such as from radar sets, and reflected electromagnetic wave signals which may originate from the hostile projectiles.

In one preferred arrangement, the remote control of the propulsion means and directional steering means of the sacrificial decoy comprises the steps of directing radio waves from the decoy vessel over predetermined arc and receiving the reflected radio waves from the seagoing vessel indicative of the position of the seagoing vessel relative to the decoy vessel. The location of the seagoing vessel is determined from the reflected radio waves. The propulsion means of the decoy vessel is controlled so that when the seagoing vessel is in a predetermined rearward segment of the predetermined arc, the propulsion means are actuated to reduce the speed of the decoy vessel. When the seagoing vessel is detected in a predetermined forward segment of the predetermined arc the propulsion means are actuated to increase the speed of the decoy vessel. The propulsion means are maintained unchanged when the seagoing vessel is in a preferred segment centrally positioned in the predetermined arc.

The directional steering means are controlled in the preferred arrangement such that the predetermined arc is radially divided into three subarcs wherein a centrally positioned subarc defines the preferred range of positions for the seagoing vessel. When the seagoing vessel is in the central subarc the directional steering means are maintained unchanged. When the seagoing vessel is detected in the starboard side subarc the directional steering means are actuated to turn the decoy vessel in the starboard direction. When the seagoing vessel is detected in the port side subarc the directional steering means are actuated to turn the decoy vessel in the port direction.

BRIEF DESCRIPTION OF THE DRAWINGS

Embodiments of the present invention will now be described by way of example with reference to the accompanying drawing, in which—

DETAILED DESCRIPTION OF THE PREFERRED EMBODIMENT

Figure 1:
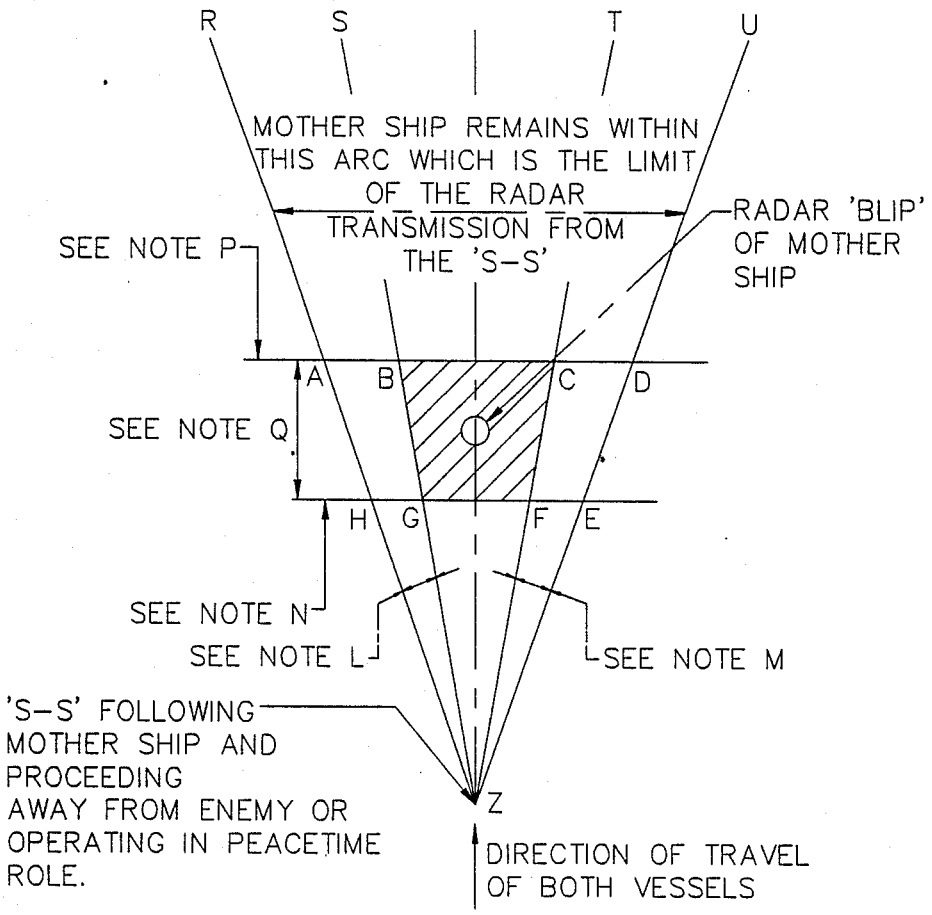
FIG. 1 is a schematic top plan view showing the radar arc from the decoy vessel which locates the protected vessel and follows behind it.

In one embodiment the sacrificial vessel of the present invention is a surface-going ship and the predetermined conventional vessel is also a surface-going ship but having conventionally low attraction to enemy missiles. The sacrificial ship is designed for operation without permanent crew at sea, without sophisticated armaments or protection or the like and in consequence is of relatively low capital cost. Furthermore the sacrificial ship is designed for low-cost maintenance by the absence of sophisticated operational components.

The sacrificial ship includes attractor means which are attractive to projectiles. These attractor means include a strong radar echo or reflection of electromagnetic wave signal, strong radar transmissions and strong heat emission. For example, to provide strong heat emission the engine-cooling water of the sacrificial ship may be circulated through deck mounted pipes. These pipes may either discharge the engine-cooling water overboard or may form a closed circuit system for the cooling water so that it is returned to the engine (or engines), cooling being effected by air passing over the pipes. The closed circuit cooling system has the advantage that it is unlikely to become contaminated by contaminants ingested from sea water or suffer from blocked seacocks etc. Both arrangements are advantageous in that icing up is retarded.

As regards providing a strong radar echo the sacrificial ship is preferably made of materials which are significantly reflective to radio waves.

The sacrificial ship may be used to protect one or more conventional seagoing vessels such as ships or other floating structures (e.g. oil rigs) and according to the protection required may be controlled from one of these conventional vessels or from a satellite or from a shore based station. For example control may be undertaken by radio or laser signal providing continuous control or initiating a preprogrammed control mode stored in a computer on the sacrificial ship. Alternatively, control may be by hard wire link from the control station which, when in the form of a conventional ship may incorporate a wire line drum for the purpose of maintaining substantially constant wire line tension.

In an alternative mode of control the sacrificial ship is controlled by radar reflection utilizing the radar system of the sacrificial ship set to transmit over a limited arc directed away from known enemy locations so as not to be detectable. The protected vessel remains in the radar arc thereby giving rise to a detected signal in the radar set of the sacrificial ship which signal is sensed by automatic sensors forming part of a servo-control for the directional steering gear and the propulsion speed control of the sacrificial ship whereby the sacrificial ship is guided to follow a path which maintains the protected vessel within the radar arc irrespective of movements of the protected vessel. Such an arrangement is illustrated in the accompanying drawing when the protected vessel is both leading and trailing the sacrificial ship.

Figure 2:
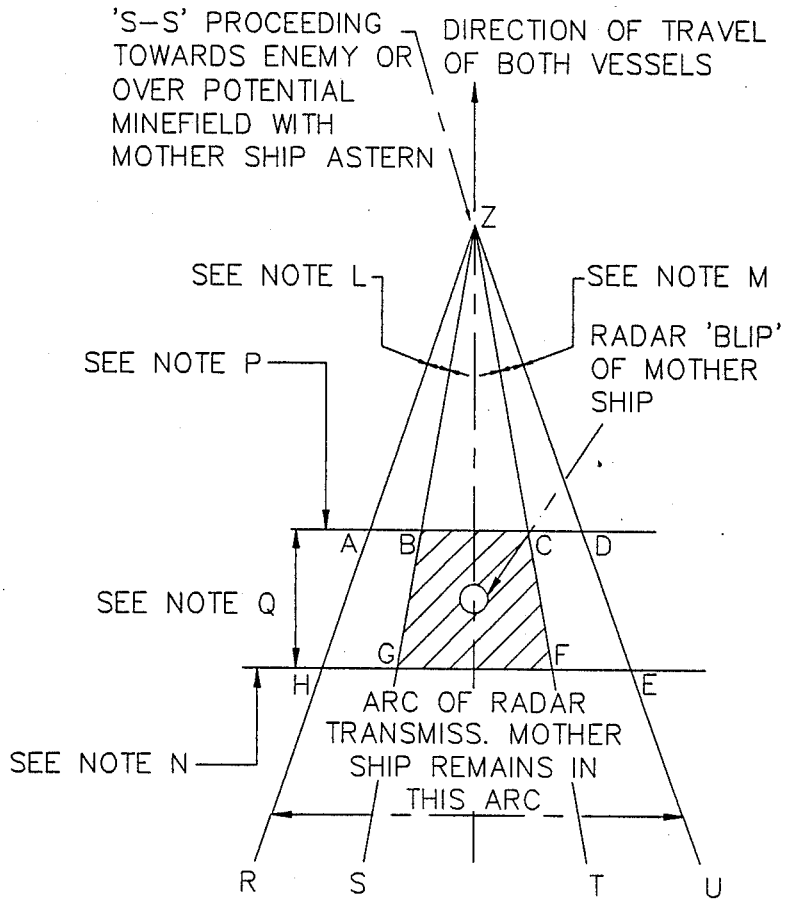
FIG. 2 is a schematic top plan view similar to FIG. 1 showing an arrangement wherein the decoy vessel is in front of the protected vessel.

Referring more particularly to the drawings, the decoy vessel directs radio waves over a predetermined arc either forwardly when following the seagoing vessel (FIG. 1) or rearwardly when leading the seagoing vessel (FIG. 2). The predetermined arc is radially divided into at least three subarcs to provide an operational system for controlling the directional steering means of the decoy vessel. The predetermined arc is further divided into at least three segments by lines at a predetermined distance from the decoy vessel which are generally perpendicular to the direction of travel of the decoy vessel so as to provide an operational system for controlling the propulsion means of the decoy vessel. By defining subarcs and segments, the decoy vessel may autonomously navigate itself to maintain the decoy vessel within a predetermined distance irrespective of the movement of the seagoing vessel.

The autonomous navigation system of the decoy vessel controls the directional steering means and the propulsion means in response to the radar system so that the seagoing vessel is preferably maintained in the central subarc and in the central segment, indicated by the shaded area in FIGS. 1 and 2. Thus for example, in the arrangement shown in FIG. 1 where the decoy vessel is trailing the seagoing vessel (mother ship), the radar "blip" of the seagoing vessel is normally located within the shaded area, and so long as the "blip" remains in this area, the decoy vessel maintains its course and speed unchanged. However, when the "blip" from the seagoing vessel is located within the forward segment, the propulsion means is actuated to increase the speed of the decoy vessel until the "blip" crosses the line dividing the forward segment from the central segment. When the "blip" from the seagoing vessel is located within the rearward segment, the propulsion means is actuated to decrease the speed of the decoy vessel so that the decoy vessel slows and eventually stops.

The directional steering means is controlled in a similar manner. So long as the "blip" from the seagoing vessel remains in the central subarc, the directional steering means leaves the course of the decoy vessel unchanged. However, when the "blip" of the seagoing vessel is located within the starboard side subarc, the directional steering means is actuated to turn the decoy vessel to the starboard. When the "blip" of the seagoing vessel is located in the port side subarc, the directional steering means is actuated to turn the decoy vessel to the port.

Conveniently the directional steering gear of the sacrificial ship incorporates single lever controls of the type where propulsion means are incorporated therein. In other words, when the engine is running but the vessel is stationary the lever is vertical, forward movement of the lever causes forward motion of the vessel and rearward movement of the lever causes rearward motion of the vessel, the extent of movement determining the vessel speed.

For the purpose of enabling the sacrificial ship to be readily boarded while at sea it is preferred that the sacrificial ship has low freeboard with side decks incorporating grab rails at deck level and guard rails with stanchions set in-board. If so desired an unimpeded flat portion or net, for example, located aft on the sacrificial ship may be provided for helicopter landings.

It will be appreciated that the sacrificial ship is intended to be manufactured sufficiently robustly to be capable of detonating mines without substantial damage to the sacrificial ship and in the event that the protected vessel is disabled or sunk and the sacrificial ship saved it forms a good rescue vessel being easy to board due to the low freeboard. Of course many of those features which make the sacrificial ship an attractive target for projectiles can be modified so that when used as a rescue vessel it is substantially unattractive to projectiles.

The sacrificial ship may also undertake an offensive role for example by remaining stationary in the water with all systems switched off and silent apart from battery operated listening devices. Such listening devices may detect submarines and detected sounds may be transmitted by radio to the protected vessel. Likewise of course the sacrificial ship may utilize its own radar set for reconnaissance purposes the resulting radar information being transmitted to the protected vessel.

In the drawings and specification, there has been set forth preferred embodiments of the invention, and although specific terms are employed, they are used in a generic and descriptive sense only and not for purposes of limitation.

That which is claimed is:

1. A method of protecting a seagoing vessel that generates signal which are attractive to hostile projectiles and which enable hostile projectiles to locate and harm the seagoing vessel, said method comprising the steps of:

providing a sacrificial decoy vessel having propulsion means and directional steering means;

directing the seagoing vessel along a path of travel;

directing radio waves from the decoy vessel over a predetermined arc in which the seagoing vessel is preferably positioned relative to the seagoing vessel;

receiving reflected radio waves from the seagoing vessel indicative of the position of the seagoing vessel relative to the decoy vessel;

determining the location of the seagoing vessel from the reflected radio waves;

controlling the propulsion means and the directional steering means of the decoy vessel so as to follow a path which maintains the decoy vessel within a predetermined distance of the seagoing vessel irrespective of the movements of the seagoing vessel as the seagoing vessel moves along its path of travel; and generating signals on the sacrificial decoy vessel which are attractive to hostile projectiles and which are substantially greater in magnitude than the projectile attractive signals generated by the seagoing vessel such that the sacrificial decoy vessel constitutes a preferred target over the seagoing vessel to hostile projectiles intended for the seagoing vessel.

2. The method according to claim 1 wherein the step of controlling the propulsion means and directional steering means further comprises the steps of dividing the predetermined arc of radio waves into at least three radial subarcs so that the central subarc defines a preferred range of positions for the seagoing vessel, maintaining the directional steering means unchanged when the seagoing vessel is positioned within the central subarc; actuating the directional steering means to turn the decoy vessel to the port when the seagoing vessel is positioned in the port side subarc; and actuating the directional steering means to turn the decoy vessel to the starboard when the seagoing vessel is positioned in the starboard side subarc.

3. The method according to claim 2 wherein the step of controlling the propulsion and directional steering means additionally comprises further dividing the predetermined arc of radio waves into at least three segments by lines at a predetermined distance from the decoy vessel and which are generally perpendicular to the direction of travel of the decoy vessel so that a central segment defines a predetermined range of preferred positions for the seagoing vessel; maintaining the propulsion means unchanged when the seagoing vessel is positioned within the central segment; actuating the propulsion means to increase the speed of decoy vessel when the seagoing vessel is positioned in the forward segment; and actuating the propulsion means to reduce the speed of the decoy vessel when the seagoing vessel is positioned within the rearward segment.

4. A method according to claim 1 wherein said step of generating signals on the decoy vessel comprises generating substantially greater heat emissions on the decoy vessel than are generated on the seagoing vessel.

5. The method according to claim 1 wherein said step of generating signals on the decoy vessel comprises generating substantially greater radio wave emissions from the decoy vessel than are generated on the seagoing vessel.

6. The method according to claim 1 wherein said step of generating signals on the decoy vessel comprises generating substantially greater electromagnetic wave reflection signals than on the decoy vessel than are generated by the seagoing vessel.

* * * * *

UNITED STATES PATENT AND TRADEMARK OFFICE

CERTIFICATE OF CORRECTION

PATENT NO. : 4,970,516

DATED : November 13, 1990

INVENTOR(S) : Ian M. Nicolson

It is certified that error appears in the above-identified patent and that said Letters Patent is hereby corrected as shown below:

Column 4, line 46, "signal" should be -- signals --

Signed and Sealed this

Seventh Day of April, 1992

*Attest:*

HARRY F. MANBECK, JR.

*Attesting Officer*

*Commissioner of Patents and Trademarks*